US006142234A

United States Patent [19]

Crain

[11] Patent Number: 6,142,234

[45] Date of Patent: Nov. 7, 2000

[54] APPARATUS AND METHOD FOR TIEBACK OF SUBSEA WELLS

[75] Inventor: Jack Crain, 107 Fabiola, Lafayette, La. 70508

[73] Assignee: Jack Crain, Broussard, La.

[21] Appl. No.: 09/039,979

[22] Filed: Mar. 16, 1998

[51] Int. Cl.[7] ..... E21B 7/128

[52] U.S. Cl. ..... 166/341; 166/345; 166/359

[58] Field of Search ..... 166/338, 344, 166/345, 359, 341

[56] References Cited

U.S. PATENT DOCUMENTS

| | | | |
|---|---|---|---|
| 3,556,039 | 1/1971 | Sfredda | 115/14 |
| 3,937,172 | 2/1976 | Castoldi | 115/12 R |
| 4,214,842 | 7/1980 | Franks | 405/191 |
| 4,423,982 | 1/1984 | Zaremba | 405/195 |
| 4,461,620 | 7/1984 | Brachet | 440/38 |
| 4,624,318 | 11/1986 | Aagaard | 166/359 |
| 5,092,711 | 3/1992 | Lagner | 405/169 |
| 5,533,574 | 7/1996 | Gonzalez | 166/358 |

OTHER PUBLICATIONS

Drawing of Circulation & Jetting Tool (Undated).

*Primary Examiner*—David Bagnell
*Assistant Examiner*—Zakiya Walker
*Attorney, Agent, or Firm*—Baker Botts L.L.P.

[57] ABSTRACT

Apparatus and method are provided for applying a force to a movable subsea member to move it into a preferred location for joining to a fixed member while the location of the movable member is monitored. Nozzles in the device are placed in the direction such that fluid exiting the nozzles creates a force so as to move the movable member into the preferred location. Fluid is pumped through the device and out through one or more nozzles. An environmental conductor may be tied back from a subsea wellhead using the apparatus and method by observing the location of the conductor over the subsea wellhead using a remotely operated vehicle (ROV) while fluid is pumped at the pressure and rate so as to move the conductor into position over the wellhead and lowering the conductor into the wellhead.

13 Claims, 4 Drawing Sheets

APPARATUS AND METHOD FOR TIEBACK OF SUBSEA WELLS

BACKGROUND OF THE INVENTION

1. Field of the Invention

This invention relates to subsea operations. More particularly, method and apparatus are provided for applying force to move a conductor or other member into a selected location for joining with another member, such as a conductor which is to be joined to a subsea wellhead.

2. Description of Related Art

Wells drilled in the water-covered areas of the earth have become an important source of energy in recent decades. There has been a steady increase in the number of wells in deeper water, and many types of apparatus and procedures are used for drilling and producing these wells. Progressing from drilling and producing wells that are serviceable by divers at moderate cost, in water depths less than about 500 feet, to wells that are in water depths of several thousand feet, it has been necessary to develop many new procedures and types of apparatus.

One of the procedures used in drilling of subsea wells in deeper water is to drill the wells from a mobile drilling rig—which may be either jack-up or floating. After the wells are drilled and completed on the sea floor, a fixed platform is constructed above the wells. The wells are drilled in a small surface area on the sea floor, through a template which contains the number of "slots", or openings which is at least as great and the number of wells. Extra slots for contingent wells normally are present. After the wells are drilled, each well is fitted with a subsea wellhead before the mobile drilling rig is moved off the wells.

To construct a platform above the wellheads, a survey is made from the subsea template on the sea floor to fixed locations in which piles are to be driven to support or anchor the platform. The platform may be fixed on legs or may be buoyant with various types of anchoring means to the sea floor. Fixed platforms with stationary legs are often the most economical form of platform down to water depths in the range of about 1,000 feet, but for greater water depths some form of buoyant or compliant platform structure is often used.

After the platform is constructed, a large casing string, often called the "environmental conductor," must be run from the platform at the sea surface to the wellhead of each well drilled. The wellhead is then "tied back" to the platform by the use of the environmental conductor. This may be 20-inch diameter casing, a 26-inch diameter casing or other large diameter casing. Water depths are often greater than divers normally operate or, at least, diving expenses are very high in water depths used. Therefore, it is common to use remotely operated vehicles (ROVs) to perform operations at the sea floor. ROVs are widely used in the offshore industry, and normally have capabilities for lighting and television viewing and have mechanical arms for manipulation of apparatus. The platforms normally contain guides for the environmental conductors, which are attached to the support members of the platform. The guides are normally placed about 100 or 150 feet apart down the platform structure and over each wellhead. The guides have an inside diameter from about two inches to about 20 inches larger than the environmental conductor which is to be employed to tie back the wellheads. Centralizers may be placed on the environmental conductor such that they will position that pipe to enter the wellhead when the guides are at least several inches larger than the environmental conductor.

Centralizers may be formed to be eccentric such that when they are present in guides nearest the wellhead they allow the environmental conductor string to enter the wellhead upon lowering of the string into place. In other platform developments, centralizers are not used and the guides in the platform are sized so as to position the environmental conductor over the wellhead so that it can enter the wellhead upon lowering if the platform is properly placed.

Since the environmental conductor is confined to guides, for the conductor to enter the subsea wellhead the platform must be precisely located over the wellheads. If the platform has not been placed within one or two inches of its desired location, it may not be possible to lower the environmental conductor into its wellhead for tieback. If divers can be used, it is common to pull the environmental conductor over the wellhead by applying a winch between legs of the platform and the environmental conductor and applying force to pull the bottom of the environmental conductor over the wellhead. Below diver depth, however, where ROVs are used for sea floor operations, a winch is not easily used and there is no method available to apply sufficient force to place the environmental conductor over the wellhead so that it can be attached. The force supplied by available ROVs is inadequate.

The use of water jets to apply force for propelling boats is known. For example, U.S. Pat. No. 4,461,620 discloses a water intake and conduit for conveying water from the intake to an aperture. U.S. Pat. No. 3,937,172 discloses a water jet propelling apparatus including jet-deflecting surfaces for controlling the thrust or deviating the jet. The use of high-pressure jets for displacing equipment used in subsea wells is not known to the inventor.

There is a need for method and apparatus which may used to position an environmental conductor string of casing over a subsea wellhead or to apply force to other subsea equipment. The method should be operable with the aid of ROVs or other means of manipulating the apparatus and viewing its position at or near the sea floor. The method and apparatus should be adaptable to a wide range of water depths and operating conditions, should employ some of the apparatus which is readily available on an offshore platform and should be simple and inexpensive to operate in the environment of use.

SUMMARY OF THE INVENTION

Mechanical apparatus is provided for placement on environmental conductor casing which extends from above and is to be attached to fixed apparatus on the sea floor. Apparatus includes a housing which is adapted to be temporarily attached to the outside wall of the conductor and which is adapted to receive high-pressure fluid from a pump and which includes nozzles for discharging the high-pressure fluid in a direction away from the center of the conductor. The apparatus is used in a method for applying a force to the conductor casing so as to allow lowering of the string into a subsea wellhead. The method involves attaching the housing having nozzles to the outside wall of the conductor at a location preferably near the bottom of the conductor string and at least below the lowest guide attached to the platform, determining the desired direction of movement of the conductor by observation with a ROV or other means, rotating the conductor so that the nozzles will direct fluid in a direction opposite to the desired direction of movement of the conductor, supplying high pressure fluid to the housing at a variable rate and adjusting the rate so as to force the conductor to the desired position. Monitoring the position of the pipe until it can be lowered into the wellhead may be performed by video cameras or an ROV near the wellhead. When the conductor is near enough centered over a wellhead for entry, the conductor is lowered to enter the wellhead. In other embodiments, housing having jets therein is attached to pipe or structural components which are to be moved into a preferred location under water and high-pressure fluid is supplied to the housing to force the component into a selected location.

DESCRIPTION OF THE PREFERRED EMBODIMENTS

Figure 1:
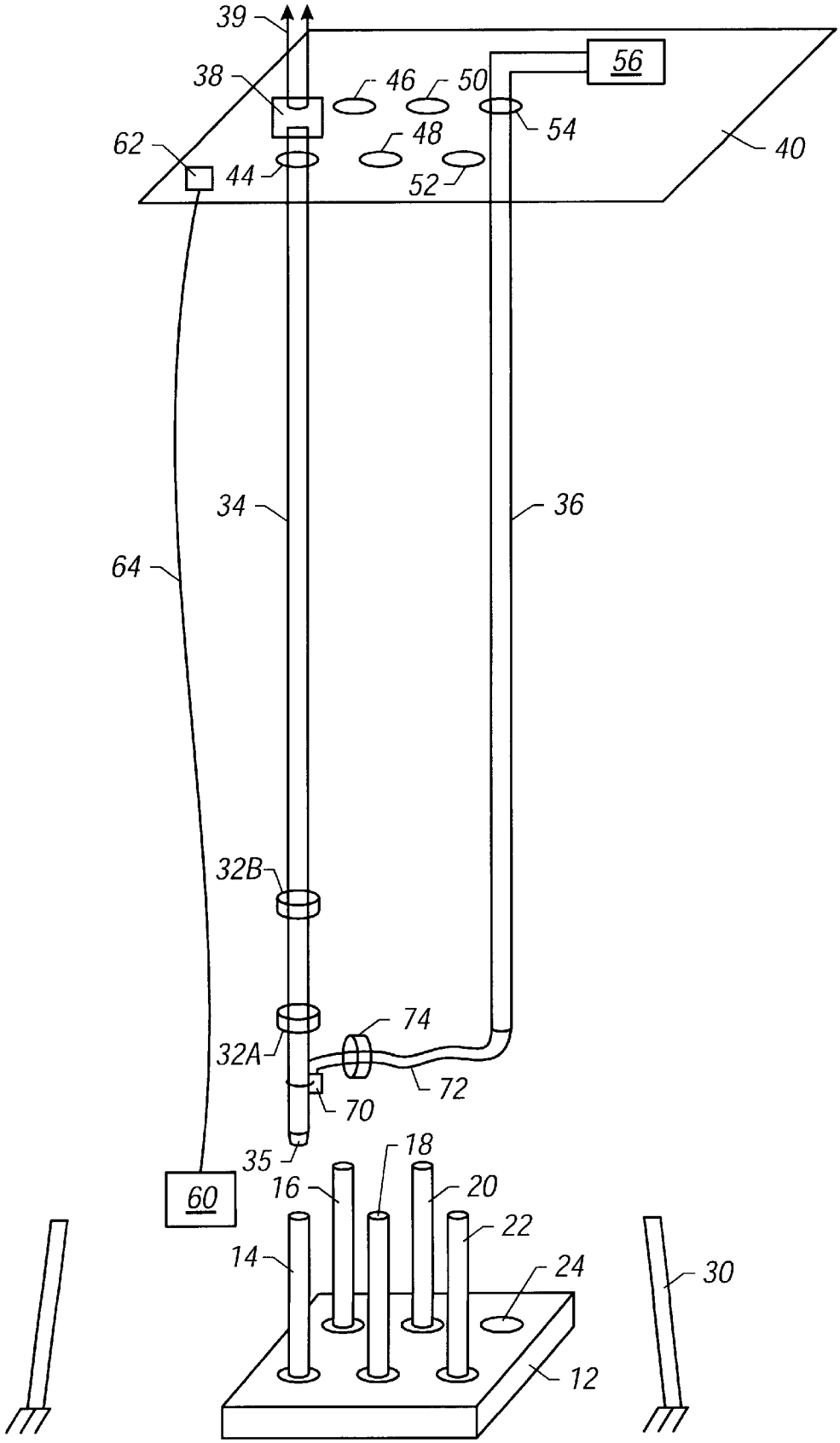
FIG. 1 is a sketch of subsea wellheads under a fixed platform with conductor pipe from the platform which is to be joined to a subsea wellhead.

Referring to FIG. 1, guide base 12 has been placed on the sea floor by the drilling rig which drilled wells (not shown) to a hydrocarbon reservoir (not shown) and placed wellheads 14, 16, 18, 20 and 22 on five wells. Extra slot 24 is open on guide base 12, but may be placed at any subsea depth. Wellheads 14–22 usually protrude several feet, in the range of 8–10 feet, above guide base 12. Wellheads are attached to casing which has been placed and cemented in the wells. A fixed platform having platform topside surface 40 has been placed over the wells and is held in place by members 30 which are anchored to the sea floor. The platform has within its structure guide rings 32A, 32B etc. Such rings are placed at intervals of 100 to 150 feet or more from near wellheads to near platform surface 40. The purpose of guide rings 32 is to allow placement of an environmental conductor such as 34 between platform surface 40 and wellheads such as 14. Such environmental conductors are lowered through the water using elevator 38 which is attached to the top joint of the string as it lowered through slots such as 44 on the platform. Slots 46, 48, 50, 52 and 54 are also present on the platform. Elevator 38 is raised and lowered by wire ropes 39 which operate from a mast or derrick (not shown). Masts or derricks can be skidded to different slots such as 44 to 54 on platforms using methods which are well known in industry.

Environmental conductor 34 is placed through the appropriate slot such as 44 on platform surface 40 and lowered through the sea, adding joints as it is lowered, and through guide rings 32 until it is within a few feet of wellhead 14. If platform 40 has been placed in precisely the location desired, it will be possible to lower conductor 34 into wellhead 14, taking advantage of nose cone 35, which has been placed in the bottom of conductor 34. Such nose cones, commonly made out of a hard plastic material, are well known in the industry. If, however, platform 40 is not precisely located where desired, it is necessary to deflect conductor 34 from the lowest guide ring 32A until it is very nearly over wellhead 14 before conductor 34 can be lowered into and attached to wellhead 14. If the water depth is greater than diving depth or great enough to cause diving to be very expensive, there is no known means of deflecting conductor 34 so as to place it in position for attaching to wellhead 14. Jetting device 70 of this invention may be attached to conductor 34 at a location on conductor 34 between lowest guide ring 32A and wellhead 14. This location may be very near the bottom of conductor 34 (within one or two feet) or may be tens of feet above the bottom of casing 34. It should be a greater distance than the distance in which conductor 34 will be inserted into the wellhead 14. Jetting device 70, a device of this invention, is mechanically attached to conductor 34 so that it will not easily rotate around or move along the axis of conductor 34 or will not move when jetting occurs through device 70. High pressure hose or movable conduit 72 is connected to jetting device 70. Hose 72 may be made neutrally buoyant by buoyant modules 74 attached thereto. The end of hose 72 is also attached to work string 36. Work string 36 is normally drill pipe, but may be any high-pressure tubular material used as a work string, including coiled tubing. Work string 36 has been run to a depth comparable to that of the bottom of conductor pipe 34 through slot 54 on platform surface 40. Work string 36 is hung from the platform and connected by high-pressure conduit to pump 56. Hose 72 may be attached to work string 36 before the work string is run into the water. The end of hose 72 is attached to jetting device 70 either when the lower joint of work string 36 is on the platform or after the bottom of work string 36 is placed near wellhead 14. Attachment of hose 72 to jetting device 70 may be accomplished using ROV 60. ROV 60 is controlled from console 62 at the surface and connected by umbilical 64. ROV 60 is used to determine the location of nose cone 35 over wellhead 14. If the bottom of conductor 34 must be moved in order to allow entry of nose cone 35 into wellhead 14, the direction of movement and the amount of movement required is determined from observations made by ROV 60. Jetting device 70 is attached to environmental conductor 34 using ROV 60, using methods more fully described below. Conductor 34 is rotated on the platform surface 40 using pipe tongs (not shown) or other means which are well known and available on the platform until nozzles on jetting device 70 are directed opposite to the desired direction of movement of conductor 34. Fluid jets from jetting device 70 provide the force necessary to move nose cone 35 over wellhead 14. Conductor 34 is then lowered into the wellhead and attached using well known methods. Nose cone 35 is withdrawn from conductor 34 in the normal procedure. ROV 60 may then be used to detach jetting device 70 from conductor 34 and place jetting device 70 in a position appropriate for use when an additional conductor string like conductor 34 is to be attached to another wellhead such as 16, 18, 20 or 22.

Figure 2:
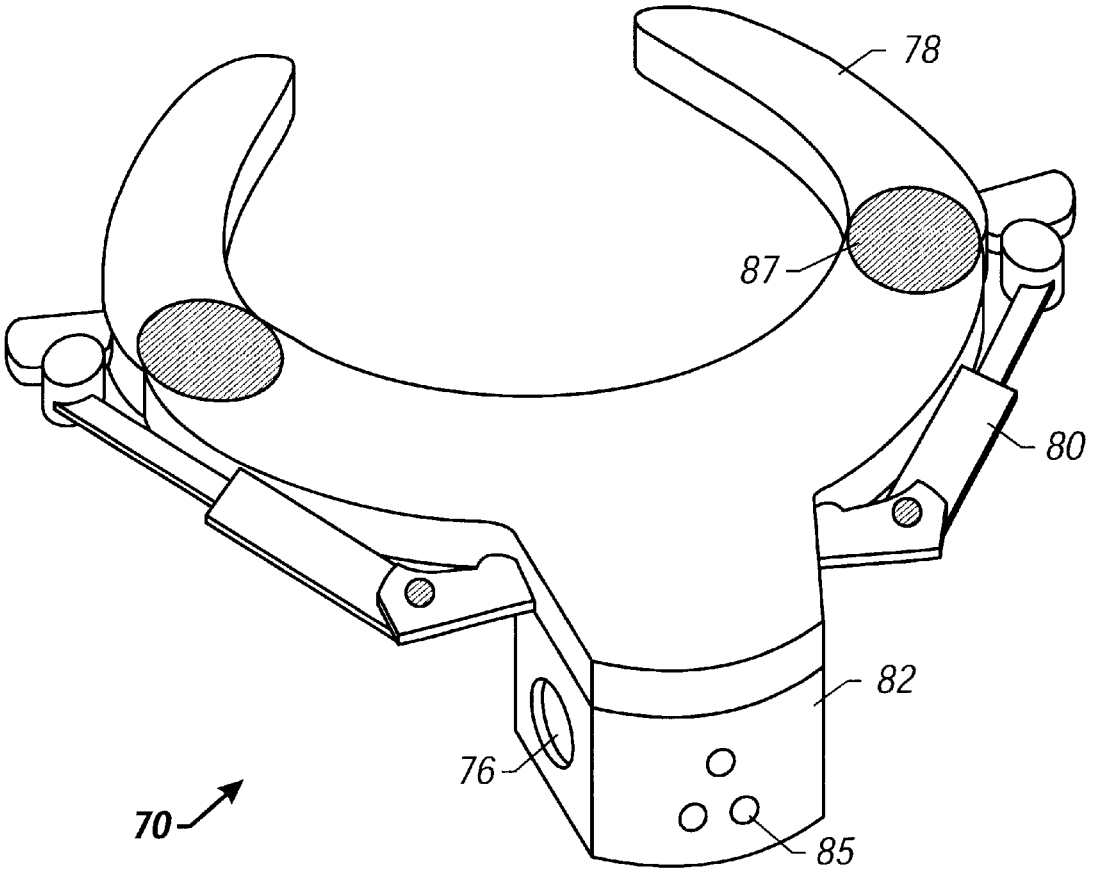
FIG. 2 is a sketch of one embodiment of a jetting device which can be attached to a conductor by mechanical arms activated by hydraulic cylinders.

Referring to FIG. 2, one embodiment of jetting device 70 is shown. Hose connector 76 is used to attach movable conduit 72 (FIG. 1). Arms 78, rotating on pivots 87, are closed by hydraulic cylinders 80 to attach jetting device 70 to a conductor. Fluid pumped into housing 82 exits at high velocity through jets 85. This causes a force in the direction opposite to the jets, allowing a conductor to be deflected into position for lowering into a wellhead or another member to be displaced for any purpose. After a conductor is in a wellhead and attached, hydraulic cylinders 80 are depressured as fluid pressure in the pumped fluid decreases, allowing arms 78 to retract from gripping. The force securing device 70 to a conductor should be adequate to prevent rotation or movement of the device with respect to the outside wall of the conductor while the device is being used to displace the conductor. A gripping surface may be applied to housing 82 or arms 78. The number of jets may be one or more, but the jet or jets should be directed so that the net displacement force is through the axis of the conductor.

Figure 3:
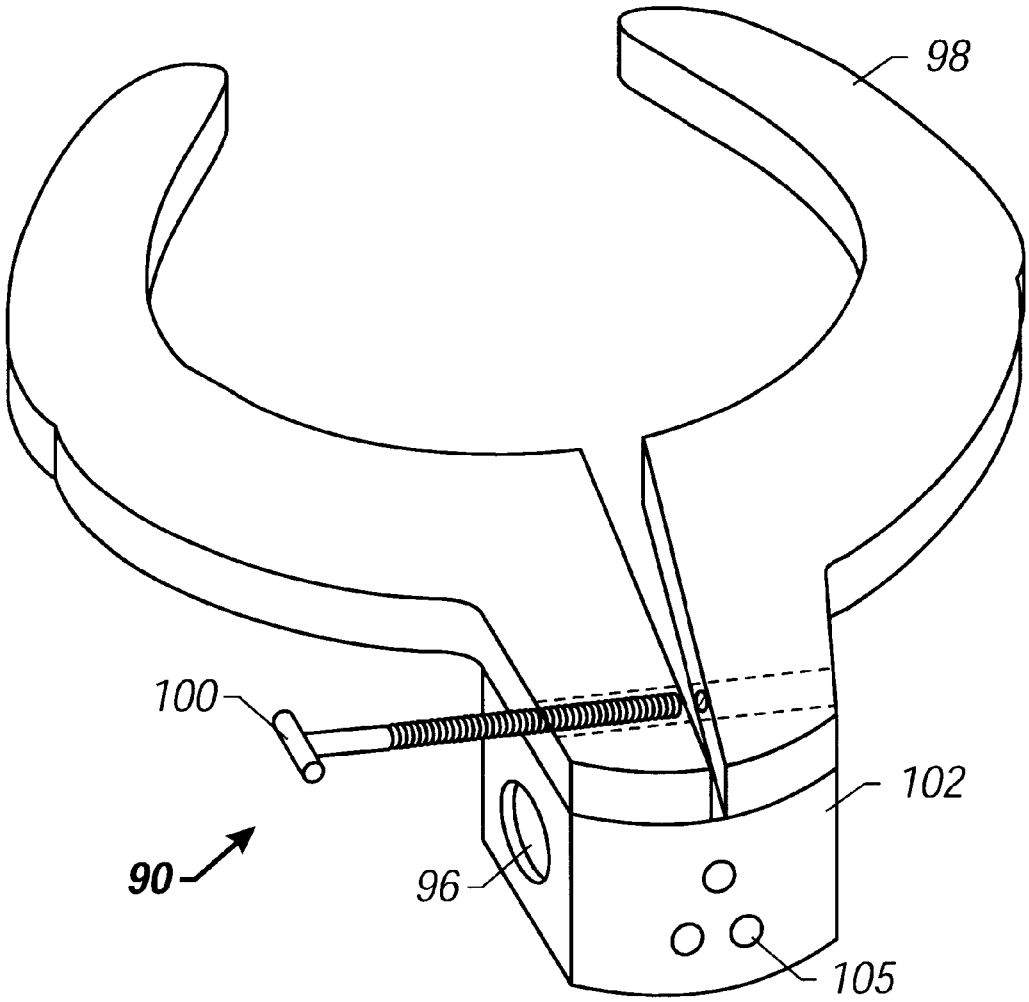
FIG. 3 is a sketch of another embodiment of a jetting device which can be attached to a conductor by mechanical arms activated by a screw mechanism.
Figure 4:
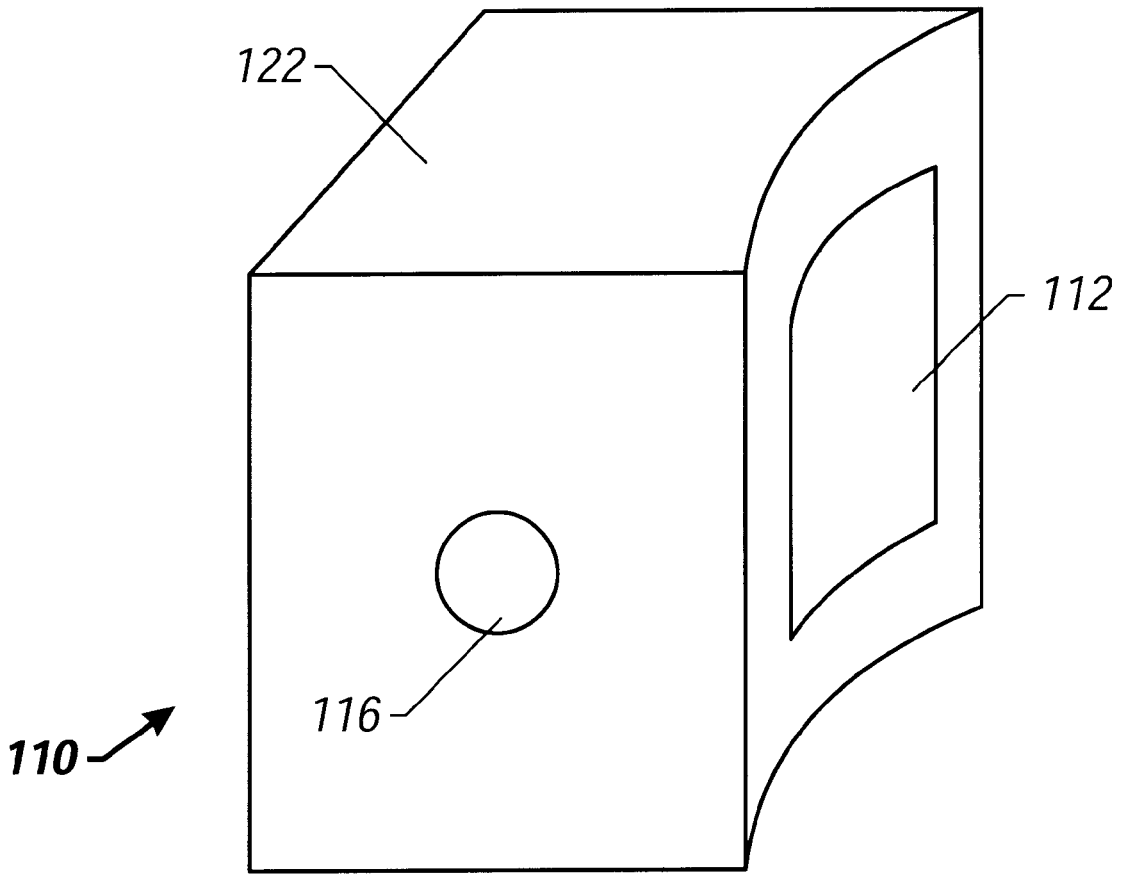
FIG. 4 is a sketch of another embodiment of a jetting device which can be attached to a conductor by a permanent magnet fixed to the device.

Other means may be provided for attaching a jetting device such as jetting device 70 to a conductor. In one embodiment of this invention, the position of arms such as arms 78 is controlled by a screw which may be turned by the arms of a ROV, as shown in FIG. 3. Jetting device 90 includes hose connector 96 and nozzles 105. Arms 98 are used to attach a conductor by moving the arms inwardly by screw 100, which may be operated by an ROV or other means. Fluid is pumped through hose connector 96 in housing 102. In another embodiment, referring to jetting device 110 in FIG. 4, permanent magnet 112 is incorporated into the wall of housing 122, the housing having nozzles 125. Fluid is pumped into the housing through hose connector 116. An ROV can place device 110 on a conductor and then pull the jetting device off the conductor after the conductor has been connected to a wellhead. Alternatively, magnet 112 may be retracted into housing 122 by attachment to a screw, which may be operated by an ROV, which pulls the magnet away from the outside wall of the conductor for a distance which makes removal of the jetting device require only a small enough force that it can be supplied by the ROV. In another embodiment, the housing of FIGS. 2, 3 or 4, having nozzles and a connector for fluid entry, may be permanently attached to a conductor before it is placed in the water by welding or mechanically fastening the housing to the outside wall of the conductor.

High-pressure fluid is supplied to the housing and therethrough to the jets by pumps located on a platform. Such pumps are generally available, as they are used for circulation of drilling fluid during drilling operations or placing other fluids in the wells. Sea water is preferably pumped, but other fluid such as drilling fluid may be used. Fluid pressures of several thousand pounds per square inch may be used. Nozzles may be replaceable nozzles, such as used in drill bits. The nozzles will be sized to achieve the desired range of force at achievable pump rates and pressure. Pump rate can be varied while deflection of the bottom of a conductor is observed. When adequate movement or deflection of the conductor has been achieved to allow the conductor to enter a wellhead, the conductor is lowered by elevator 38 (FIG. 1) by movement of wire ropes 39. Nose cone 35 is removed by known techniques and ROV 60 may be used to connect conductor 34 to wellhead 14. ROV 60 removes jetting device 70 and preferably places it on guide base 12 or other location where it can be retrieved by a ROV and used to repeat the operation described above for other conductors.

Although the operations described herein have been described with respect to placement of a conductor in a wellhead to tie-back the wellhead to a platform, it should be understood that the method of this invention can be applied to move other equipment or apparatus into a desired location for subsea operations. For example, a connection of one pipe to another, when one of the pipes is fixed, can be achieved by applying the jetting device of this invention to the movable pipe and supplying high pressure fluid to the jetting device as described above. Similarly, a member of a structure being formed subsea can be moved into a location such that it can be joined by attachment of the jetting device of this invention to the member by ROV or other means and supplying high pressure fluid to the jetting device. Although use of an ROV has been discussed herein, it should be understood that any means for performing the functions of an ROV can be used instead. This would include use of fixed or permanent television cameras or other position indicators and the use of fixed mechanical manipulations.

It should be understood that various modification of the techniques, procedures, methods, materials and equipment will be apparent to those of ordinary skill in the art. It is intended that all such variations within the scope and spirit of the appended claims be embraced thereby.

What I claim is:

1. A method for attaching a conductor having a lower end to a subsea wellhead having an upper receiving body, comprising the steps of:

lowering the lower end of the conductor to a location near the wellhead;

placing a work string in proximity to the lower end of the conductor and attaching a movable conduit thereto;

attaching a jetting device having a nozzle to the outside of the conductor at a selected distance above the lower end of the conductor and attaching the movable conduit to the jetting device;

directing the nozzle in a direction so as to move the conductor over the wellhead; and while observing the location of the lower end of the conductor with respect to the upper receiving body of the wellhead, pumping fluid through the jetting device at a selected rate to move the conductor into position over the upper receiving body then lowering the conductor into the upper receiving body and attaching the conductor thereto.

2. The method of claim 1 wherein the work string is a string of drill pipe or tubing.

3. The method of claim 1 wherein the work string is coiled tubing.

4. The method of claim 1 wherein the jetting device is attached to the outside of the conductor by hydraulic force acting on a mechanical arm.

5. The method of claim 1 wherein the jetting device is attached to the outside of the conductor by a mechanical screw mechanism.

6. The method of claim 1 wherein the jetting device is attached to the outside of the conductor by a magnetic force.

7. The method of claim 1 wherein the jetting device is permanently attached to the outside of the conductor before the conductor is moved into position over the upper receiving body.

8. The method of claim 1 wherein the step of observing the location of the lower end of the conductor is carried out by use of a remotely operated vehicle.

9. The method of claim 1 wherein the movable conduit is a hydraulic hose with buoyant modules attached thereto.

10. The method of claim 1 wherein the jetting device comprises a housing, a means for connecting the movable conduit thereto and a means for securing the device to the outside of the conductor with a force adequate to prevent rotation or movement of the device with respect to the outside of the conductor while the device is being used to displace the conductor.

11. A method for moving an apparatus into a preferred location subsea, comprising the steps of:

lowering the apparatus into a location near the preferred location;

placing a work string in proximity to the location of the apparatus and attaching a movable conduit thereto;

attaching a jetting device having a nozzle to the apparatus at a selected location on the apparatus and attaching the movable conduit to the jetting device;

directing the nozzle in a direction so as to move the apparatus in a selected direction; and while observing the location of the apparatus, pumping fluid through the jetting device at a selected rate so as to move the apparatus into the preferred location subsea.

12. The method of claim 11 wherein the location of the apparatus is observed with a television camera.

13. The method of claim 12 wherein the television camera is attached to a ROV.

* * * * *